US009213310B2

(12) United States Patent
Mizuno et al.

(10) Patent No.: US 9,213,310 B2
(45) Date of Patent: Dec. 15, 2015

(54) EXHAUST PURIFICATION APPARATUS

(71) Applicant: Konica Minolta Inc., Chiyoda-ku (JP)

(72) Inventors: Hiroshi Mizuno, Aisai (JP); Shigeru Tashiro, Toyokawa (JP); Kuniya Matsuura, Toyohashi (JP); Masahiro Yamaguchi, Toyokawa (JP); Masayuki Satou, Toyohashi (JP); Shoichi Yoshikawa, Okazaki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/564,771

(22) Filed: Dec. 9, 2014

(65) Prior Publication Data

US 2015/0168912 A1 Jun. 18, 2015

(30) Foreign Application Priority Data

Dec. 13, 2013 (JP) ..... 2013-258472

(51) Int. Cl.
*G03G 21/20* (2006.01)
*G03G 15/00* (2006.01)

(52) U.S. Cl.
CPC ..... *G03G 21/206* (2013.01); *G03G 15/55* (2013.01); *G03G 2221/1645* (2013.01)

(58) Field of Classification Search
CPC ..... G03G 21/206; G03G 15/0258; G03G 15/107; G03G 21/20
USPC ..... 399/93
See application file for complete search history.

(56) References Cited

U.S. PATENT DOCUMENTS 5,635,142 A * 6/1997 Ichiki et al. ..... 422/177
2009/0326721 A1 12/2009 Sugiyama et al.
2011/0211859 A1* 9/2011 Shimoyama et al. ..... 399/93

FOREIGN PATENT DOCUMENTS

JP 2010-008024 A 1/2010

OTHER PUBLICATIONS

Machine translation of Reiko JP 2004-116322 A, publication date: Apr. 15, 2004.*

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An exhaust purification apparatus includes: a purification duct configured to purify air to be discharged from a ventilation port in an image forming apparatus, the purification duct including: at least one inlet communicating with an interior of the purification duct for connection with the ventilation port in the image forming apparatus; an outlet configured to discharge air inside the purification duct to the outside; a fan configured to direct air from the inlet toward the outlet; a filter configured to recover particles in the air, the fan and the filter each being disposed in the purification duct at a position between the inlet and the outlet; an airflow detector configured to detect an airflow at the inlet; and a controller configured to execute a normal mode and an attachment determination mode.

11 Claims, 8 Drawing Sheets

EXHAUST PURIFICATION APPARATUS

The entire disclosure of Japanese Patent Application No. 2013-258472 filed on Dec. 13, 2013 including description, claims, drawings, and abstract are incorporated herein by reference in its entirety.

BACKGROUND OF THE INVENTION

1. Field of the Invention

Embodiments of the present invention relate to exhaust purification apparatuses configured to purify exhaust from image forming apparatuses containing byproducts to be generated with image formation.

2. Description of the Related Art

It has been known that various byproducts are generated with image formation in an image forming apparatus such as a copier and a printer, a facsimile, or a multifunction machine that integrally has these functions. The byproducts include, for example, effluvium, VOC (Volatile Organic Compounds), low-molecular siloxane, and dust such as toner and paper powder. Image forming apparatuses are typically configured such that byproducts generated thereinside are sucked into an exhaust duct, and that the sucked byproducts are captured by a standardized internal filter that is disposed in the middle of an exhaust path of the exhaust duct. This allows the exhaust to become harmless in terms of meeting a certain criterion.

However, this does not mean that byproducts are thoroughly captured by the internal filter. For example, the standard for the internal filter is not directed to byproducts of a particle diameter that is even smaller than a minimum size capturable by the internal filter, and thus such byproducts pass through the internal filter and are exhausted out of the image forming apparatus from an outlet. Hence, some users of the image forming apparatus desire that the exhaust which meets the standard by passing the internal filter be further purified.

As a method of purifying exhaust from an image forming apparatus, it is conceivable that an air purifier is positioned in the vicinity of an image forming apparatus that is already installed. The air purifier, however, is configured to capture byproducts that have been discharged once out of the image forming apparatus. Hence, depending on the air purifier, the exhaust from the image forming apparatus may not be completely purified.

Hence, it is conceivable that the image forming apparatus is attached at an outlet thereof with an exhaust purification apparatus having a purification filter for further purifying exhaust from the image forming apparatus. This allows the exhaust from the image forming apparatus to be fully taken into the exhaust purification apparatus directly from the outlet, such that air purified by the purification filter of the exhaust purification apparatus is exhausted from the exhaust purification apparatus.

Such an exhaust purification apparatus uses a fan for discharging air inside the exhaust purification apparatus. The purification filter of the exhaust purification apparatus captures byproducts of a particle diameter that is so small that the internal filter of image forming apparatus is unable to capture. Hence, the purification filter has a finer mesh and larger ventilation resistance as compared to the internal filter. This is to prevent the ventilation resistance of the purification filter from interfering with air discharge to be performed by the image forming apparatus.

Here, it is assumed that a user connects the exhaust purification apparatus to an outlet of the image forming apparatus. However, some image forming apparatuses have, for example, an inlet for taking air into the image forming apparatus as a ventilation port that is open to the outside, in addition to the outlet for discharging air from the image forming apparatus. In such an image forming apparatus, it may be difficult for the user to distinguish between the outlet and the inlet based on the appearance of the apparatus. In case where the user erroneously connects the exhaust purification apparatus to an inlet, the image forming apparatus may not be operable to properly suck air from the inlet due to airflow that is generated by the fan for performing air discharge of the exhaust purification apparatus. This may adversely affect the image forming apparatus.

Hence, a countermeasure is taken with the exhaust purification apparatus which allows for accurate distinction as to whether the ventilation port that is connected with the exhaust purification apparatus is an outlet, and in case where that ventilation port is not an outlet, for prevention of functional interference with the ventilation port. More specifically, detection is made of an airflow that goes in and out of the image forming apparatus, so as to prevent blocking of the airflow to a maximum extent. For example, JP 2010-008024 A discloses a technique of detecting an airflow and performing control based on the detected airflow.

According to JP 2010-008024 A, a plurality of server apparatuses is arranged on a rack inside a server room, which apparatuses are configured to perform air intake and air discharge when in operation so as to cool the interior. The server apparatuses are each provided with a temperature measurer for measuring the temperature of the sucked air and a detector for detecting whether it is an air intake/air discharge state or not. Air conditioning control is performed inside the server room based on the temperature of air sucked into a server apparatus in operation, of which server apparatus the detector detects an air intake/air discharge state.

However, the above-described JP 2010-008024 A relates to a technique of air conditioning to perform temperature control inside a server room, and is not applicable to an exhaust purification apparatus designed for purifying exhaust from an image forming apparatus.

SUMMARY OF THE INVENTION

Embodiments of the present invention are made in view of the foregoing of circumstances relating to the background techniques, and an object of the present invention is to provide an exhaust purification apparatus that is used with an image forming apparatus by being attached thereto, and that is operable to suppress an adverse effect on the internal devices of the image forming apparatus to which the exhaust purification apparatus is attached, as well as degradation in quality of images to be formed, while adequately recovering byproducts to be generated with image formation.

To achieve at least one of the abovementioned objects, according to an aspect, an exhaust purification apparatus reflecting one aspect of the present invention comprises a purification duct configured to purify air to be discharged from a ventilation port in an image forming apparatus. The purification duct includes: at least one inlet communicating with an interior of the purification duct for connection with the ventilation port in the image forming apparatus; an outlet configured to discharge air inside the purification duct to the outside; a fan configured to direct air from the inlet toward the outlet; a filter configured to recover particles in the air, the fan and the filter each being disposed in the purification duct at a position between the inlet and the outlet; an airflow detector configured to detect an airflow at the inlet; and a controller configured to execute a normal mode and an attachment determination mode. The normal mode is adapted such that the fan is driven with the inlet being in connection with the ventilation port in the image forming apparatus, so as to purify an exhaust from the ventilation port in the image forming apparatus. The attachment determination mode is adapted such that a determination is made as to whether the ventilation port in the image forming apparatus being in connection with the inlet is a ventilation port for discharging air, based on the airflow detected by the airflow detector. The controller is configured to perform a disabling control to disable the connection of the inlet with the ventilation port in the image forming apparatus, the inlet having been determined in the attachment determination mode as being in connection with the ventilation port other than the ventilation port for discharging air in the image forming apparatus. The controller is configured to execute the normal mode in presence of the inlet having a non-disabled connection.

The exhaust purification apparatus according to an embodiment of the present invention is operable to determine in the attachment determination mode as to whether the ventilation port in the image forming apparatus being in connection with the inlet is configured to perform air discharge or not. With respect to the inlet that is determined as being in connection with the ventilation port other than the ventilation port for discharging air in the image forming apparatus, the disabling control is performed to disable the connection. This allows byproducts generated with image formation to be appropriately recovered while suppressing an adverse effect on the internal devices of the image forming apparatus that is attached with the exhaust purification apparatus as well as degradation in quality of images to be formed.

In the exhaust purification apparatus, during execution of the attachment determination mode, the controller is preferably configured to determine that the inlet is in connection with the ventilation port for discharging air in the image forming apparatus when the airflow detector detects at the inlet an airflow flowing from an exterior toward the interior of the purification duct, and the controller is preferably configured to determine that the inlet is in connection with the ventilation port other than the ventilation port for discharging air in the image forming apparatus in absence of the determination that the inlet is in connection with the ventilation port for discharging air in the image forming apparatus. This allows for adoption of an inexpensive airflow detector that is operable to detect an airflow flowing from the exterior toward to interior of the inlet.

In the exhaust purification apparatus, during execution of the attachment determination mode, the controller is preferably configured to determine that the inlet is in connection with the ventilation port for discharging air in the image forming apparatus when the airflow detector detects at the inlet the airflow flowing from the exterior toward the interior of the purification duct, the airflow having an air volume that is at or above a predefined threshold air volume. This is because in case where the image forming apparatus has a ventilation port designed for free convection or weak air discharge, the free convection or the weak air discharge is prevented from being inhibited by disabling the connection of the inlet with such a ventilation port.

In the exhaust purification apparatus, the controller is preferably configured to execute the attachment determination mode with the fan being stopped. This is because the airflow at the ventilation port in the image forming apparatus is not obstructed by an airflow created by the action of the fan, thus preventing an erroneous determination.

The exhaust purification apparatus further preferably includes an opener positioned on an upstream side of the fan in a direction of flow of air inside the purification duct, the opener having a closed state and an open state, the closed state being such that the interior and the exterior of the purification duct are in non-communication, the open state being such that the interior and the exterior of the purification duct are in communication. The opener is preferably configured to disable the connection of the inlet with the image forming apparatus when in the open state. This is because the connection of the inlet is easily disabled.

The exhaust purification apparatus further preferably includes: a display configured to display information to a user; and an inputter configured to accept an input from the user to initiate the execution of the attachment determination mode. The controller is preferably configured to cause an instruction to be displayed on the display when the inlet is connected to the ventilation port in the image forming apparatus and power is first turned on, the instruction prompting the input onto the inputter. This is because a determination is made at an initial stage of the connection of the inlet as to whether the exhaust purification apparatus is properly attached to the image forming apparatus, and the improper attachment state is eliminated.

In the exhaust purification apparatus, the airflow detector is preferably configured to detect the airflow at the inlet during non-operation of the apparatus. The controller is preferably configured to execute the attachment determination mode when the airflow detector detects at the inlet the airflow flowing from the exterior toward the interior of the purification duct during non-operation of the apparatus. The controller is preferably configured to execute the normal mode following the disabling control, in the presence of the inlet that is determined in the attachment determination mode as being in connection with the ventilation port other than the ventilation port for discharging air in the image forming apparatus, and the controller is preferably configured to execute the normal mode without performing the disabling control, in the absence of the inlet that is determined in the attachment determination mode as being in connection with the ventilation port other than the ventilation port for discharging air in the image forming apparatus. Some image forming apparatuses have a ventilation port that is switchable between air intake and air discharge per job. Thus, in case where the inlet is connected to such a ventilation port, a determination whether the connection is appropriate or not is made per execution of a job, and an improper connection is eliminated.

In the exhaust purification apparatus, the controller is preferably configured to cause, in the disabling control, the display to display an instruction for disabling the connection of the inlet with the image forming apparatus. This is because the user is instructed of a proper attachment state of the exhaust purification apparatus to the image forming apparatus.

The exhaust purification apparatus preferably further includes an opener driver configured to perform an opening and closing operation of the opener. The controller is preferably configured to cause, in the disabling control, the opener driver to open the opener. This is because, in case of presence of the inlet being in connection with the ventilation port other than the ventilation port for discharging air in the image forming apparatus, the connection with that ventilation port in the image forming apparatus is disabled automatically.

In the exhaust purification apparatus, the controller is preferably configured to cause the opener driver to close the opener with respect to the inlet that is determined in the attachment determination mode as being in connection with the ventilation port for discharging air in the image forming apparatus. In case where a determination is made in the previous attachment determination mode that the ventilation port is other than the ventilation port for discharging air, the connection of the inlet to that ventilation port is disabled automatically. Even in such a case, the inlet is disabled once, and then when air discharge is performed at the ventilation port connected with the inlet, the disabled inlet is brought back to the enabled state from the disabled state, so as to purify the exhaust from the image forming apparatus.

The exhaust purification apparatus preferably further includes: a plurality of inlets identical to the inlet; and a plurality of fans provided for the plurality of the inlets, the fans being identical to the fan. The controller is preferably configured to perform the disabling control in such a manner as to execute the normal mode with a fan of the fans being stopped, the fan corresponding to an inlet of the inlets that is determined in the attachment determination mode as being in connection with the ventilation port other than the ventilation port for discharging air in the image forming apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

A first embodiment of the present invention is described in detail below with reference to the accompanying drawings. As the schematic configuration depicted in FIG. 1, the present embodiment relates to an exhaust purification apparatus 100 for use with an image forming apparatus. The exhaust purification apparatus 100 is used by being connected to outlets of an image forming apparatus 1. The image forming apparatus 1 is configured to fix toner images on sheets by an electrographic method to form images.

Figure 1:
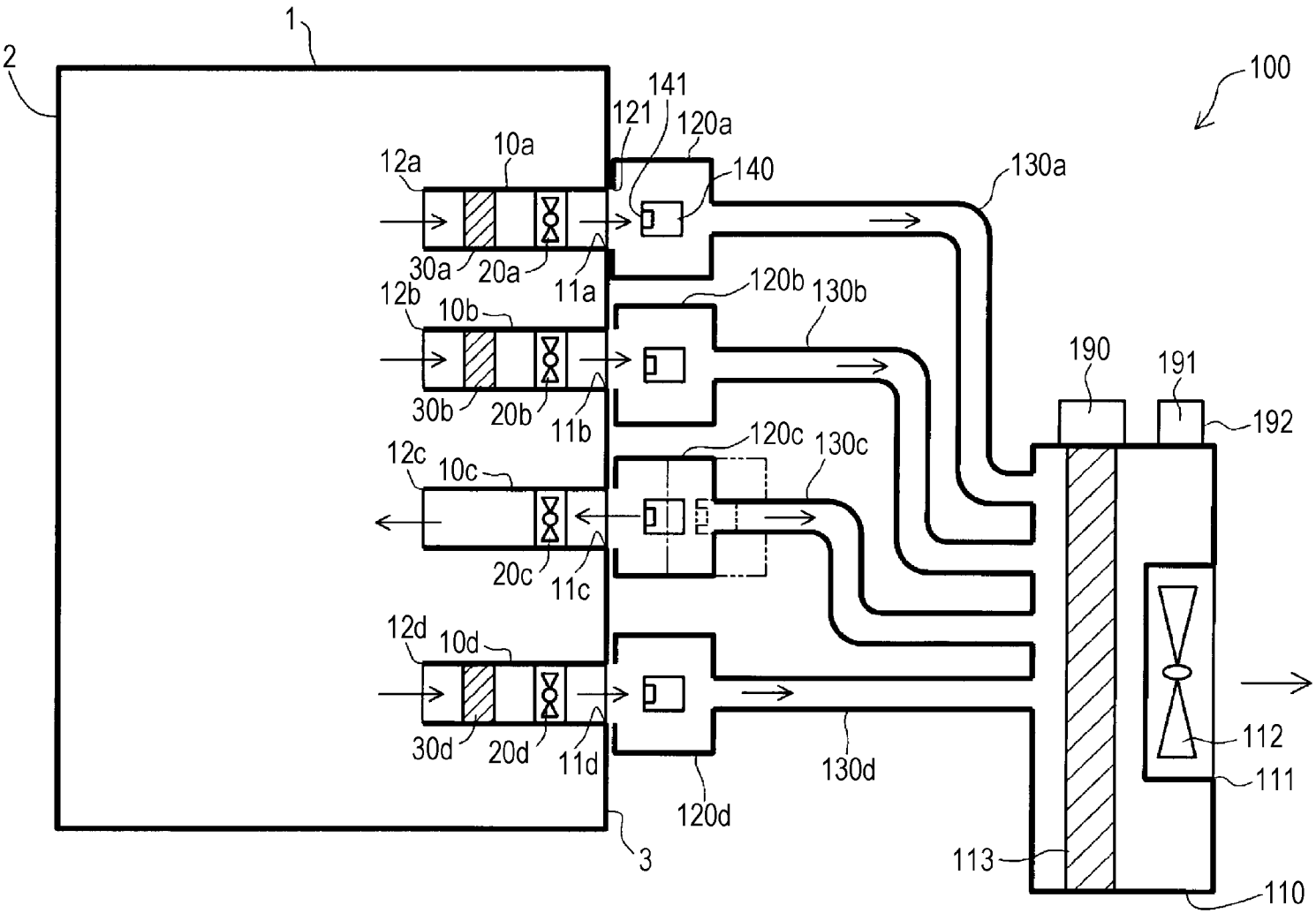
FIG. 1 is an explanatory schematic configuration diagram of an exhaust purification apparatus according to a first embodiment.

In the image forming apparatus 1 depicted in FIG. 1, the left-hand side is a front side 2 of the apparatus, and the right-hand side is a rear side 3 of the apparatus. Thus, for example, an operation panel for allowing the user to operate the image forming apparatus 1 is provided on the front side 2. Further, as depicted in FIG. 1, the image forming apparatus 1 has on its rear side 3 a plurality of ventilation ports 11*a*, 11*b*, 11*c*, and 11*d*.

The ventilation ports 11*a*, 11*b*, and 11*d* of the ventilation ports 11*a*, 11*b*, 11*c*, and 11*d* are outlets for discharging internal air out of the image forming apparatus 1. In the following description, the ventilation ports 11*a*, 11*b*, and 11*d* are thus also referred to as outlets 11*a*, 11*b*, and 11*d*. Meanwhile, the ventilation port 11*c* is an inlet for taking external air into the image forming apparatus 1. In the following description, the ventilation port 11*c* is thus also referred to as an inlet 11*c*.

The ventilation ports 11*a*, 11*b*, 11*c*, and 11*d* are provided with internal ducts 10*a*, 10*b*, 10*c*, and 10*d*, respectively, on the inner side of the apparatus. The respective ends of the internal duct 10*a*, 10*b*, 10*c*, and 10*d* on the opposite side from the ventilation ports 11*a*, 11*b*, 11*c*, and 11*d* are provided with openings 12*a*, 12*b*, 12*c*, and 12*d* that are open inside the apparatus.

The openings 12*a*, 12*b*, and 12*d* of the openings 12*a*, 12*b*, 12*c*, and 12*d* are open at, for example, positions at which byproducts are generated inside the apparatus. Specifically, the byproducts include, for example, toner that has not been properly fixed on sheets, and low-molecular siloxane generated from molten toner at the time of fixing processing. Thus, the openings 12*a*, 12*b*, and 12*d* are open, for example, in the vicinity of a developing device for forming toner images and a fixing device for performing fixing of toner images on sheets. Meanwhile, the opening 12*c* is open in the vicinity of an internal structure to be cooled, such as a hard disk drive.

Further, the internal ducts 10*a*, 10*b*, 10*c*, and 10*d* are provided therein with internal fans 20*a*, 20*b*, 20*c*, and 20*d*, respectively. The internal fans 20*a*, 20*b*, 20*c*, and 20*d* are driven when the image forming apparatus 1 is in operation, for example, for image formation. The internal fans 20*a*, 20*b*, and 20*d* of the internal fans 20*a*, 20*b*, 20*c*, and 20*d* are configured to discharge air inside the internal ducts 10*a*, 10*b*, and 10*d* out of the apparatus. Meanwhile, the internal fan 20*c* is configured to take external air into the internal duct 10*c*.

Further, the internal ducts 10*a*, 10*b*, and 10*d* are provided therein with internal filters 30*a*, 30*b*, and 30*d*. The internal filters 30*a*, 30*b*, and 30*d* are configured to recover byproducts contained in the air that passes the locations of the filters according to a certain standard.

When the internal fan 20*c* is driven, external air is sucked from the inlet 11*c* into the internal duct 10*c*. The air sucked into the internal duct 10*c* is blown out through the opening 12*c*. Cooling targets inside the image forming apparatus 1 are thereby cooled.

Meanwhile, when the internal fans 20*a*, 20*b*, and 20*d* are driven, air in the vicinity of the openings 12*a*, 12*b*, and 12*d* is sucked into the internal ducts 10*a*, 10*b*, and 10*d*, respectively. At this time, byproducts in the vicinity of the openings 12*a*, 12*b*, and 12*d* are also sucked into the internal ducts 10*a*, 10*b*, and 10*d* together with the air. The air inside the internal ducts 10*a*, 10*b*, and 10*d* passes through the internal filters 30*a*, 30*b*, and 30*d*, respectively, such that the byproducts therein is removed, and then is discharged through the outlets 11*a*, 11*b*, and 11*d* to the outside of the image forming apparatus 1. This allows the air discharged from the outlets 11*a*, 11*b*, and 11*d* to be made harmless in terms of meeting a certain standard.

However, some users of the image forming apparatus 1 desires that the exhaust that has been made harmless in terms of meeting the standard be further purified. More specifically, air discharged from the outlets 11*a*, 11*b*, and 11*d* sometimes contains byproducts that are not recoverable by the internal filters 30*a*, 30*b*, and 30*d*.

Byproducts that are discharged from the outlets 11*a*, 11*b*, and 11*d* are, for example, byproducts of a particle diameter that is even smaller than the minimum particle diameter of the byproducts collectable by the internal filters 30*a*, 30*b*, and 30*d*. The exhaust purification apparatus 100 depicted in FIG. 1 is configured to recover such byproducts that are not recoverable by the internal filters 30*a*, 30*b*, and 30*d*.

The exhaust purification apparatus 100 has a main body portion 110, intake portions 120*a*, 120*b*, 120*c*, and 120*d*, and hose ducts 130*a*, 130*b*, 130*c*, and 130*d*. The intake portions 120 are each connected by way of the hose ducts 130 to the main body portion 110.

The main body portion 110 has an exhaust fan 112 and a purification filter 113 therein. The exhaust fan 112 is configured to discharge air inside the exhaust purification apparatus 100 through an outlet 111 to the outside of the exhaust purification apparatus 100. The purification filter 113 has higher performance then the internal filters 30*a*, 30*b*, and 30*d* of the image forming apparatus 1 and is operable to recover byproducts that are not recoverable by the internal filters 30*a*, 30*b*, and 30*d*. Specifically, the purification filter 113 recovers byproducts of a particle diameter that is even smaller than the minimum particle diameter of the byproducts that are recoverable by the internal filters 30*a*, 30*b*, and 30*d*.

The exhaust purification apparatus 100 drives the exhaust fan 112 to purify the air inside the exhaust purification apparatus 100 with the purification filter 113 for discharge from the outlet 111.

The intake portions 120 are used for connection with the outlets of the image forming apparatus and are each provided with an inlet 121. When the exhaust fan 112 is driven, air is sucked from the outside to the inside through the inlets 121 of the exhaust purification apparatus 100. The intake portions 120 have the inlets 121 connected correspondingly to the outlets of the image forming apparatus. The intake portions 120 are connected to the outlets of the image forming apparatus by using adhesive tapes or magnets.

The hose ducts 130 are freely bendable by the user and are flexibly operable. Thus, the exhaust purification apparatus 100 according to the present embodiment is attachable to an image forming apparatus that has, for example, ventilation ports that are arranged differently from the ventilation ports 11 of the image forming apparatus 1. For example, the exhaust purification apparatus 100 is connectable to an image forming apparatus that has an outlet in a lateral side in addition to the rear side of the apparatus.

The intake portions 120 each include an air volume sensor 140 therein. The air volume sensors 140 are arranged with detectors 141 thereof directed toward the respective inlets 121 of the intake portions 120. Thus, the air volume sensors 140 are operable to detect the flow rate of flow of air that flows into the exhaust purification apparatus 100 from the inlets 121. More specifically, exhaust from the image forming apparatus is detectable where the intake portions 120 are connected to the outlets of the image forming apparatus.

Meanwhile, the flow of air that flows to the outside through the inlets 121 from inside the exhaust purification apparatus 100 is not detectable with the air volume sensors 140. Thus, airflow that flows from the inlets 121 of the intake portions 120 to the hose ducts 130 is detectable by the air volume sensors 140. It is to be noted that the air volume sensors 140 may be replaced with sensors that are operable to further detect flow of air that flows out from the exhaust purification apparatus 100 through the inlets 121 to the outside.

Moreover, a controller 190 and a display 191 are arranged on an upper portion of the main body portion 110. The display 191 is configured to appropriately display, for example, instructions to the user to be described later on a display panel 192 that is disposed on the right-hand side in FIG. 1. The controller 190 is configured to perform control over the portions of the exhaust purification apparatus 100. The controller 190 according to the present embodiment is configured to control, for example, operation of the exhaust fan 112 and display operation by the display 191 based on the airflow detected by the air volume sensors 140.

The exhaust purification apparatus 100 according to the present embodiment has a normal mode and an attachment determination mode. Exhaust from the image forming apparatus is purified in the normal mode. Determination is made as to whether attachment of the exhaust purification apparatus 100 to the image forming apparatus is appropriate nor not in the attachment determination mode. The normal mode and the attachment determination mode are executed by the controller 190. The normal mode causes the exhaust fan 112 to be driven, such that the air inside the exhaust purification apparatus 100 is discharged from the outlet 111 through the purification filter 113.

The normal mode is executed when the image forming apparatus with the exhaust purification apparatus 100 attached thereto is in operation and also the attachment determination mode is not being executed. Whether the image forming apparatus is in operation may be determined based on whether any of the air volume sensors 140 of the intake portions 120 is detecting exhaust from the image forming apparatus.

The image forming apparatus 1 depicted in FIG. 1 has, as described earlier, the internal fans 20 driven while the apparatus is in operation such as image formation and is performing air discharge through the outlets 11*a*, 11*b*, and 11*d*. Thus, the exhaust is discharged into the intake portion 120*a*, 120*b*, and 120*d* that are connected to the outlets 11*a*, 11*b*, and 11*d* of the image forming apparatus 1, respectively. Hence, any of the air volume sensors 140 of the intake portion 120*a*, 120*b*, and 120*d* detects exhaust from the image forming apparatus 1, thus detecting whether the image forming apparatus 1 is in operation.

Further, in the normal mode, the exhaust fan 112 is driven, such that the air discharged from the outlets of the image forming apparatus connected with the intake portions 120 is passed through the purification filter 113 for purification and the air is then discharged from the outlet 111.

Meanwhile, the attachment determination mode is for determining whether the exhaust purification apparatus 100 is properly attached to the image forming apparatus or not. The exhaust purification apparatus 100 is attached to the image forming apparatus via the intake portions 120 being connected to the outlets of the image forming apparatus. More specifically, for the image forming apparatus 1 of FIG. 1, the intake portions 120 are preferably connected exclusively to the outlets 11*a*, 11*b*, and 11*d* of the image forming apparatus 1.

In FIG. 1, the intake portions 120*a*, 120*b*, 120*c*, and 120*d* of the exhaust purification apparatus 100 are connected to the ventilation ports 11*a*, 11*b*, 11*c*, and 11*d* of the image forming apparatus 1, respectively. However, the ventilation port 11*c* of the ventilation ports 11 of the image forming apparatus 1 is an inlet. Thus, when the normal mode is executed with the intake portion 120*c* connected to the inlet 11*c*, air intake from the inlet 11*c* by the internal fan 20*c* is inhibited.

This is because when the exhaust fan 112 is driven, the air inside the intake portion 120*c*, i.e., the air to be sucked from the inlet 11*c*, flows toward the main body portion 110 of the exhaust purification apparatus 100. Thus, cooling is not properly conducted in the vicinity of the opening 12*c* of the internal duct 10*c*, which may adversely affect the operation of the cooling target. More specifically, in the attachment state depicted in FIG. 1, the exhaust purification apparatus 100 is not properly attached to the image forming apparatus 1, and execution of the normal mode in this state is not favorable.

An improperly attached state as depicted in FIG. 1 is likely to occur, for example, when the user purchases the exhaust purification apparatus 100 and attaches the exhaust purification apparatus 100 to the already installed image forming apparatus 1 by herself. From the appearance of the image forming apparatus 1, the outlets 11*a*, 11*b*, and 11*d* look like the inlet 11*c*. Further, in case where flow of air is weak in the outlets 11*a*, 11*b*, and 11*d* and the inlet 11*c*, the user is unable to accurately discern the direction of the airflow. In other words, it is difficult for the user to distinguish between the outlets 11*a*, 11*b*, and 11*d* and the inlet 11*c* of the image forming apparatus 1.

Thus, in the exhaust purification apparatus 100 according to the present embodiment, the attachment determination mode is executed to determine whether the exhaust purification apparatus 100 is appropriately attached to the image forming apparatus or not. This eliminates an improperly attached state as depicted in FIG. 1 and provides for a properly attached state. In FIG. 1, the properly attached state of the exhaust purification apparatus 100 to the image forming apparatus 1 is depicted by the alternate long and short dashed line where the intake portion 120*c* is not connected to the inlet 11*c*.

The attachment determination mode is executed, for example, when the exhaust purification apparatus 100 is attached to the image forming apparatus and the exhaust purification apparatus 100 is powered on. The attachment determination mode to be executed at an initial stage of attachment of the exhaust purification apparatus 100 to the image forming apparatus is hereinafter referred to as an attachment initial determination mode. The attachment determination mode includes a per-job determination mode in addition to the attachment initial determination mode. The per-job determination mode is executed per execution of a job in the image forming apparatus with the exhaust purification apparatus 100 attached thereto.

Figure 2:
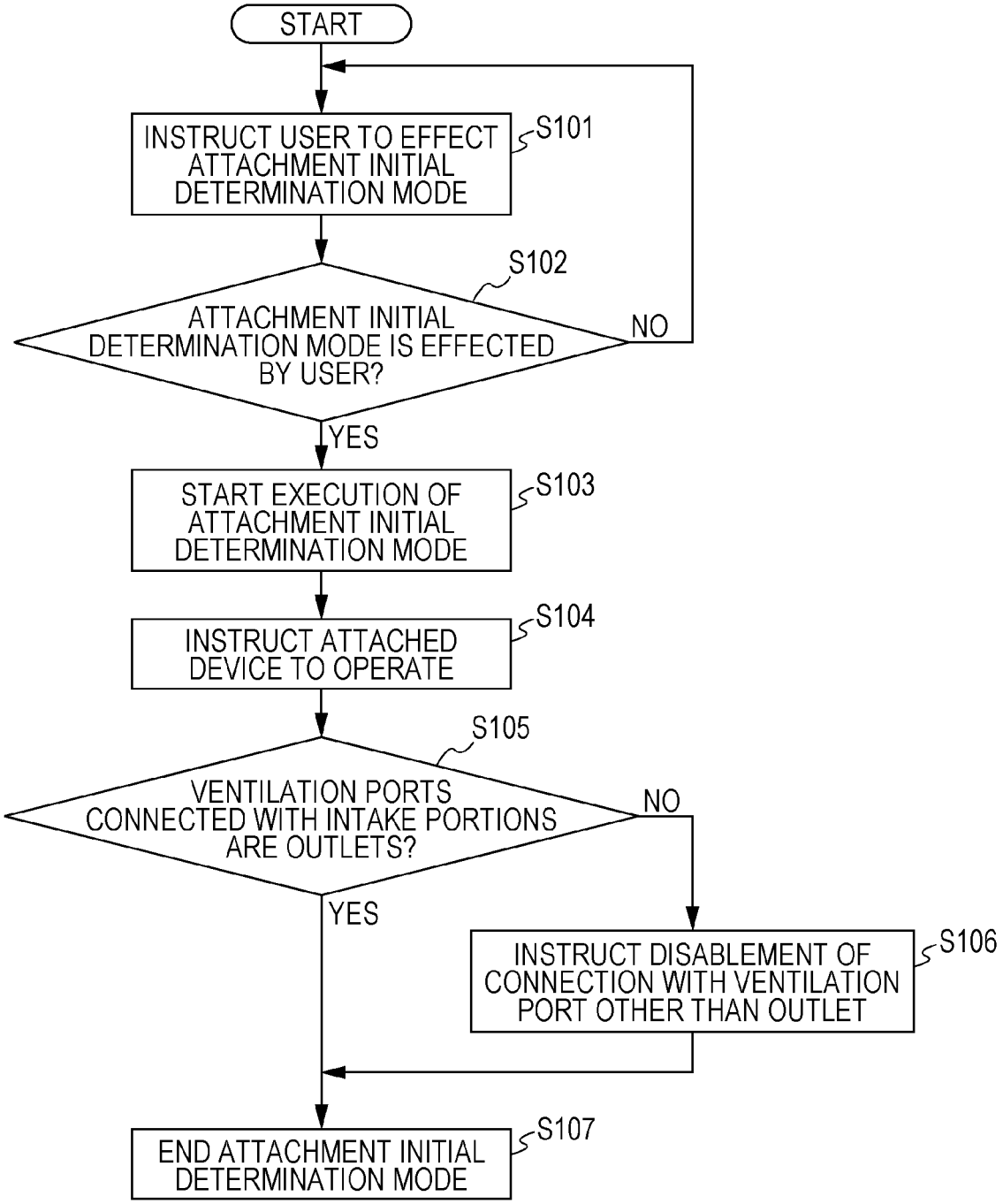
FIG. 2 is an explanatory flowchart of an attachment initial determination mode.

FIG. 2 is a flowchart depicting a procedure for carrying out the attachment initial determination mode. First, the exhaust purification apparatus 100 is attached to the image forming apparatus, and the exhaust purification apparatus 100 is powered on, when the controller 190 instructs the user to input an instruction to effect the attachment initial determination mode (S101). Specifically, for example, a message saying "carry out the attachment initial determination mode" is displayed on the display panel 192 of the display 191. The instruction for the user to effect the attachment initial determination mode (S101) is continued until the user inputs the instruction to effect the attachment initial determination mode (S102: NO).

It is to be noted that, since the user performs input of the instruction to effect the attachment initial determination mode, an inputter may be provided on the main body portion 110 to initiate the attachment initial determination mode. Alternatively, a warning lamp may be provided to the exhaust purification apparatus 100, such that the warning lamp is turned on when the display 191 has a display for prompting the user to input the instruction thereon.

Next, when the user inputs the instruction to effect the attachment initial determination mode of the exhaust purification apparatus 100 (S102: YES), execution of the attachment initial determination mode is started (S103). While the attachment initial determination mode is being executed, the exhaust fan 112 is not in operation. Then, the controller 190 instructs the user to cause the image forming apparatus with the exhaust purification apparatus 100 attached thereto to operate (S104). Specifically, a message such as "run the image forming apparatus" is displayed on the display panel 192 of the display 191. Further, the display 191 may display the number of sheets to be subjected to the image forming operation by the image forming apparatus, e.g., ten sheets for printing.

Subsequently, when the operation of the image forming apparatus with the exhaust purification apparatus 100 attached thereto is started, determination is made whether the ventilation ports to which the intake portions 120 are connected are outlets or not (S105). More specifically, an intake portion 120 of which exhaust is detected by the air volume sensor 140 is determined as being connected to an outlet. Meanwhile, an intake portion 120 of which the air volume sensor 140 does not detect exhaust is determined as being connected to a ventilation port that is not an outlet.

In FIG. 1, when the image forming apparatus 1 makes an operation, air is discharged from the outlets 11*a*, 11*b*, and 11*d* of the image forming apparatus 1. Thus, such air discharge is performed in the intake portions 120*a*, 120*b*, and 120*d*, so as to be detected by the respective air volume sensors 140 of the intake portions 120. In other words, when exhaust is detected by each of the air volume sensors 140 of the intake portions 120*a*, 120*b*, and 120*d*, it is determinable that the intake portions 120*a*, 120*b*, and 120*d* are connected to the outlets 11*a*, 11*b*, and 11*d* of the image forming apparatus 1.

Meanwhile, the air volume sensor 140 obviously does not detect exhaust with respect to the intake portion 120*c* connected to the inlet 11*c* of the image forming apparatus 1. Thus, in case of the attachment state depicted in FIG. 1, it is determined that the ventilation ports 11*a*, 11*b*, 11*c*, and 11*d* connected with the intake portions 120*a*, 120*b*, 120*c*, and 120*d* are not outlets altogether (S105: NO). In this case, an instruction is issued to the user to disable connection with the ventilation port 11*c* that is not an outlet (S106). Specifically, a message such as "confirm that the intake portion 120*c* is not in connection" is displayed on the display panel 192 of the display 191.

This allows the user to detach the intake portion 120*c* from the inlet 11*c*, so as to achieve a state in which the connection is disabled, which state is indicated by an alternate long and short dashed line in FIG. 1. More specifically, a state is achieved in which the exhaust purification apparatus 100 is properly attached to the image forming apparatus 1 with the intake portions 120*a*, 120*b*, and 120*d* connected to the outlets 11*a*, 11*b*, and 11*d*. Hence, the attachment initial determination mode allows an improperly attached state of the exhaust purification apparatus 100 to the image forming apparatus 1 to be eliminated, so as to achieve a properly attached state. After the instruction in step S106, the attachment initial determination mode of the exhaust purification apparatus 100 is terminated (S107).

Meanwhile, for example, in case where the ventilation port 11*c* is an outlet unlike FIG. 1 in a state where the intake portions 120*a*, 120*b*, 120*c*, and 120*d* are connected to the ventilation ports 11*a*, 11*b*, 11*c*, and 11*d*, respectively, the intake portions 120 are each connected to outlets. In this case, therefore, it is determined that the ventilation ports 11*a*, 11*b*, 11*c*, and 11*d* connected with the intake portions 120*a*, 120*b*, 120*c*, and 120*d* are outlets (S105: YES), and the attachment initial determination mode is terminated (S107).

Thus, in case where the user erroneously connects an intake portion 120*c* of the exhaust purification apparatus 100 to the inlet 11*c* of the image forming apparatus 1, the attachment initial determination mode allows the connection to be disabled, so as to achieve a properly attached state. In this manner, air intake at the inlet 11*c* of the image forming apparatus 1 is not inhibited in case where the normal mode of the exhaust purification apparatus 100 is executed thereafter. Hence, exhaust from the image forming apparatus 1 is purified by the exhaust purification apparatus 100 without an adverse effect being inflicted on the image forming apparatus 1.

Figure 3:
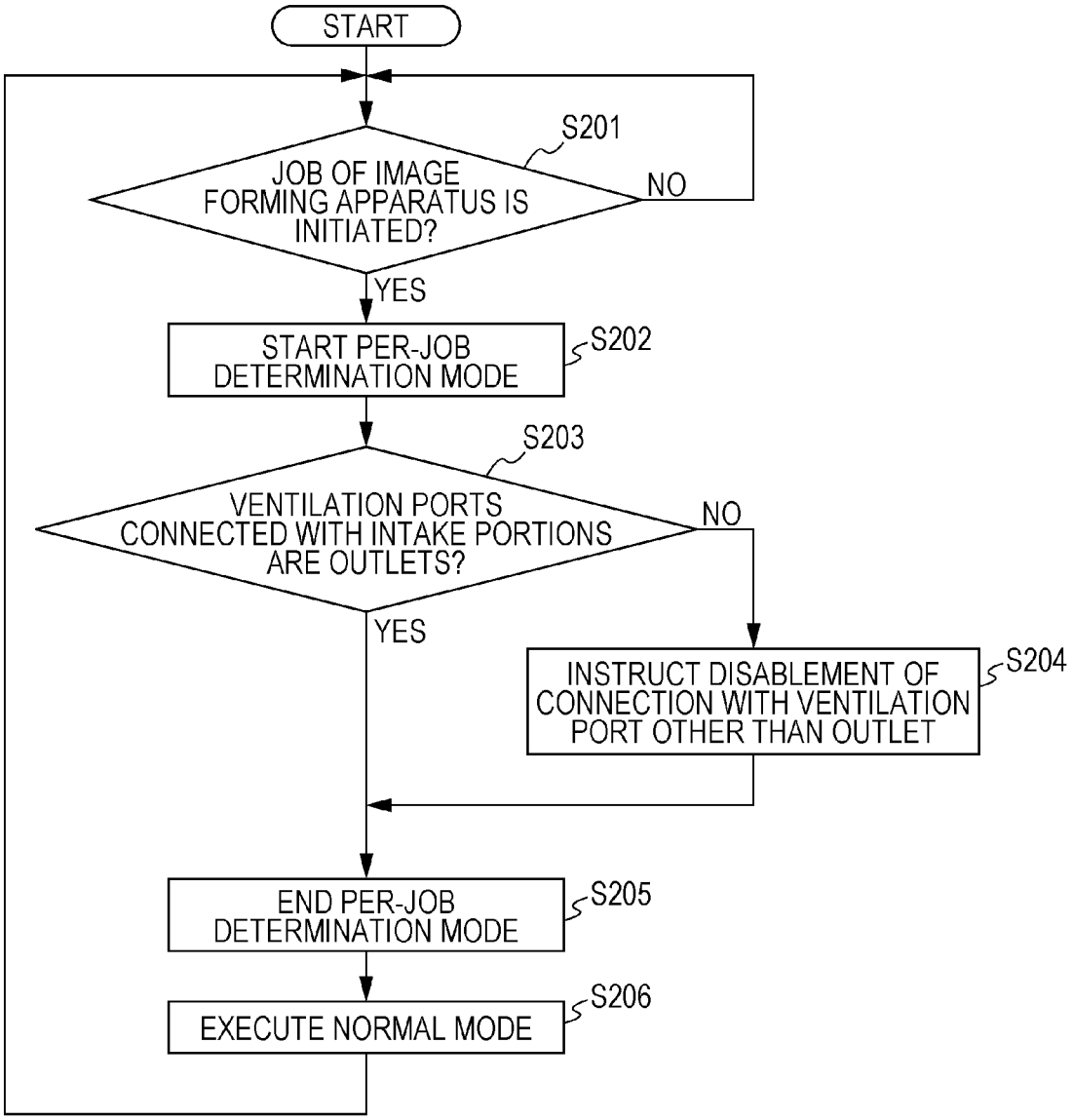
FIG. 3 is an explanatory flowchart of a per-job determination mode.

Next, description is given of a procedure for carrying out the per-job determination mode to be performed per execution of a job in the image forming apparatus having the exhaust purification apparatus 100 attached thereto with reference to FIG. 3. The per-job determination mode is specifically useful in case where, for example, the connection of the intake portion 120 to an inlet is not properly disabled at the time of execution of the above-described attachment initial determination mode (FIG. 2). Moreover, the per-job determination mode is specifically useful in case where the image forming apparatus has a ventilation port that is switchable between air discharge and air intake depending on the job to be executed.

As depicted in FIG. 3, the controller 190 first determines whether a job of the image forming apparatus has been started or not until the job is started (S201: NO). Then, when it is determined that the job has been started based on detection of exhaust from the image forming apparatus by an air volume sensor 140 of any of the intake portions 120 (S201: YES), execution of the per-job determination mode is started (S202). The exhaust fan 112 is in an off state also while the per-job determination mode is being executed.

In the per-job determination mode, as in the earlier-described attachment initial determination mode, determination is made whether each ventilation port that is connected with the intake portion 120 is an outlet or not based on whether the air volume sensor 140 of each intake portion 120 detects exhaust or not (S203).

More specifically, in case where the attachment state is as FIG. 1 at the time of starting of a job, the intake portion 120*c* is in connection with the inlet 11*c*, and thus it is determined that the ventilation ports 11 connected with the intake portions 120 are not outlets altogether (S203: NO). Thus, an instruction is issued to the user to disable the connection of the intake portion 120*c* that is connected to the ventilation port 11*c* which is not an outlet (S204). This allows the user to detach the intake portion 120*c* from the inlet 11*c*, so as to achieve a properly attached state. Then, the exhaust purification apparatus 100 terminates the per-job determination mode (S205) and executes the normal mode, so as to perform purification of exhaust from the image forming apparatus 1 (S206).

Meanwhile, in case where determination is made that the ventilation ports connected with the intake portions 120 are entirely outlets (S203: YES), the per-job determination mode is terminated (S205), and the normal mode is executed (S206). After that, determination may be made such that the job is completed when air discharge from the image forming apparatus to be detected by the air volume sensors 140 of the intake portions 120 is entirely stopped, and the normal mode may be terminated. Then, the normal mode is terminated and the exhaust fan 112 is stopped, and the process returns to step S201 to stand by until the next job is started (S201).

Hence, the per-job determination mode allows the user to be informed again that the connection of an intake portion 120 to a non-outlet ventilation port is not properly disabled in the attachment initial determination mode. Further, the user is also given an instruction for a proper state of attachment of the exhaust purification apparatus 100 to the image forming apparatus for each job to be executed by the image forming apparatus in case where the image forming apparatus has a ventilation port that is switchable between air discharge and air intake per job. It is to be noted that the normal mode may naturally be executed specifically in the presence of an intake portion 120 of which the connection is not disabled. This is because there is no point of executing the normal mode where connection is entirely disabled with respect to the intake portions 120.

Both the above-described attachment determination modes are described of a case in which the ventilation ports of the image forming apparatus are either an outlet or an inlet. However, some image forming apparatuses have a ventilation port designed for free convection with which, for example, an internal fan is not disposed thereinside, or a ventilation port designed for weak air discharge. The intake portions 120 are preferably not connected to such ventilation ports. This is because connecting an intake portion 120 may cause air to be discharged from such a ventilation port in a larger air volume than is expected for free convection or weak air discharge. Thus, it may also be configured such that the controller 190 specifically determines that a ventilation port is an outlet when an exhaust air volume at or larger than a predetermined threshold for the exhaust air volume is detected of the ventilation port.

More specifically, in step S105 of the attachment initial determination mode (FIG. 2), determination is preferably made, when the exhaust air volume detected by an air volume sensor 140 is at or above a predetermined threshold, that the intake portion 120 is connected to an outlet of the image forming apparatus. This stands true for step S203 of the per-job determination mode (FIG. 3). This allows the connection of an intake portion 120 to be disabled by way of an instruction in the attachment determination mode, even in case where the intake portion 120 is connected to a ventilation port designed for free convection or weak air discharge.

Figure 4:
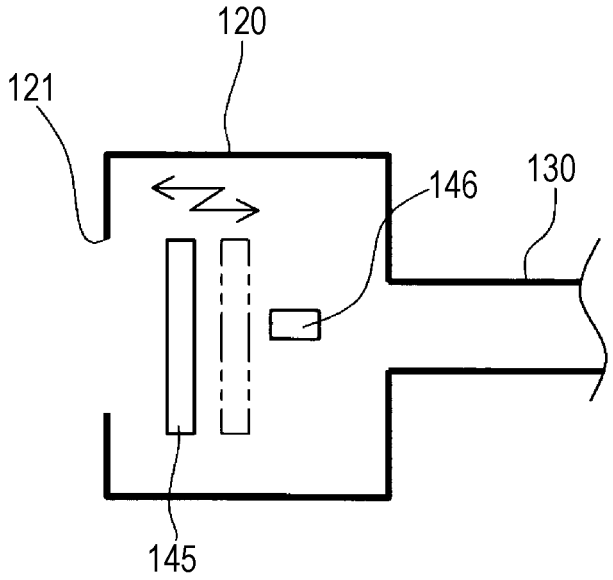
FIG. 4 is an explanatory diagram of a variation of a configuration for detecting exhaust.

Further, in the above description, whether a ventilation port connected with an intake portion 120 is an outlet or not is determined based on the air volume sensors 140 for detecting the exhaust air volumes; however, the configuration is not limited thereto. For example, as depicted in FIG. 4, it may be configured such that the intake portions 120 each have a movable body 145 and a detector 146 therein. The position of the movable body 145 that is indicated by the solid line in FIG. 4 is a position when air is yet to flow from the inlet 121 into the intake portion 120. When the intake portion 120 is connected to an outlet and air is discharged from the outlet, the movable body 145 is then moved by the exhaust to the position indicated by the alternate long and short dashed line in FIG. 4. The detector 146 is configured to detect the movable body 145 at the position indicated by the alternate long and short dashed line in FIG. 4. Hence, determination is made as to whether a ventilation port connected with an intake portion 120 is an outlet or not also by using the configuration as depicted in FIG. 4. It is to be noted that the movable body 145 obviously does not move to the position indicated by the alternate long and short dashed line in FIG. 4 in case where the intake portion 120 is connected to an inlet and air intake is conducted through the connected inlet.

Further, the per-job determination mode described with reference to FIG. 3 may be executed again per elapse of a predefined length of time even after the normal mode is started in step S206. Some image forming apparatuses have a ventilation port that is switchable between air discharge and air intake even during the execution of a job. In case where the ventilation port connected with an intake portion 120 switches from air discharge to air intake while a job is being executed, connection of the intake portion 120 to that ventilation port is disabled, such that appropriate air intake is performed at the ventilation port.

In the normal mode, it is preferred that the pressure on the upstream side of the purification filter 113 in the exhaust path inside the exhaust purification apparatus 100 be set at or below the atmospheric pressure. In case where the pressure on the upstream side of the purification filter 113 of the exhaust purification apparatus 100 is a positive pressure, air discharge from the outlet of the image forming apparatus, which outlet is connected with an intake portion 120, is obstructed. When air discharge is not properly performed in the image forming apparatus, the quality of images to be formed may be degraded. Moreover, this may invite malfunction of the image forming apparatus.

In addition, it is preferred in the normal mode that the pressure on the upstream side of the purification filter 113 of the exhaust purification apparatus 100 be set within a range of −30 Pa to 0 Pa in terms of the gauge pressure, which is a difference between the absolute pressure and the atmospheric pressure. In case where the pressure on the upstream side of the purification filter 113 of the exhaust purification apparatus 100 is too low, air discharge from the outlet of the image forming apparatus, which outlet is connected with an intake portion 120, is intensified too much. In case where the outlet at which air discharge is intensified performs air discharge, for example, in the vicinity of the fixing device configured to fix toner on a sheet upon heating, the heating may not be properly performed, causing degradation in image quality.

It is to be noted that control of the pressure on the upstream side of the purification filter 113 of the exhaust purification apparatus 100 may be performed, for example, by control of a drive voltage for the exhaust fan 112 as well as adjustment of an amount of air to be discharged from the outlet 111 by the exhaust fan 112. Further, the pressure on the upstream side of the purification filter 113 of the exhaust purification apparatus 100 is detectable, for example, with a pressure sensor disposed at the position.

As has been described in detail above, the exhaust purification apparatus 100 according to the present embodiment is operable to allow the intake portions 120 having the inlets 121 to be connected to outlets of the image forming apparatus, and to purify the exhaust in the normal mode. In case where an intake portion 120 is connected to a non-outlet ventilation port of the image forming apparatus, the user is instructed of a proper attachment state in the attachment determination mode. In this manner, an exhaust purification apparatus is achieved which is attached to an image forming apparatus for use and is operable to properly recover byproducts to be generated with image formation while suppressing an adverse effect on the internal devices of the image forming apparatus with the exhaust purification apparatus attached thereto as well as degradation in quality of images to be formed.

It is to be noted that the present embodiment is merely an illustration and is not intended to limit the present invention in any way. Accordingly, the embodiment of the present invention naturally allows for various improvements and modifications without departing from the scope of the invention. For example, the hose ducts may each be provided with the purification filter. And for example, the intake portions and the hose ducts may be provided in any number. Further, the present embodiment is applicable to, for example, a so-called four-cycle electrographic image forming apparatus in which developing devices for each color are disposed around one photosensitive body, in addition to the above-described image forming apparatus 1 in the form of a tandem electrographic color printer. Moreover, the present embodiment is applicable to, for example, monochrome copiers and printers, facsimiles, or multifunction machines integrally having these functions.

Second Embodiment

A second embodiment is described. Unlike the first embodiment, an exhaust purification apparatus according to the present embodiment has an opening in each hose duct. In case of the presence of an intake portion connected to a non-outlet ventilation port, the opening is operated, such that the connection is disabled without detaching the intake portion.

Figure 5:
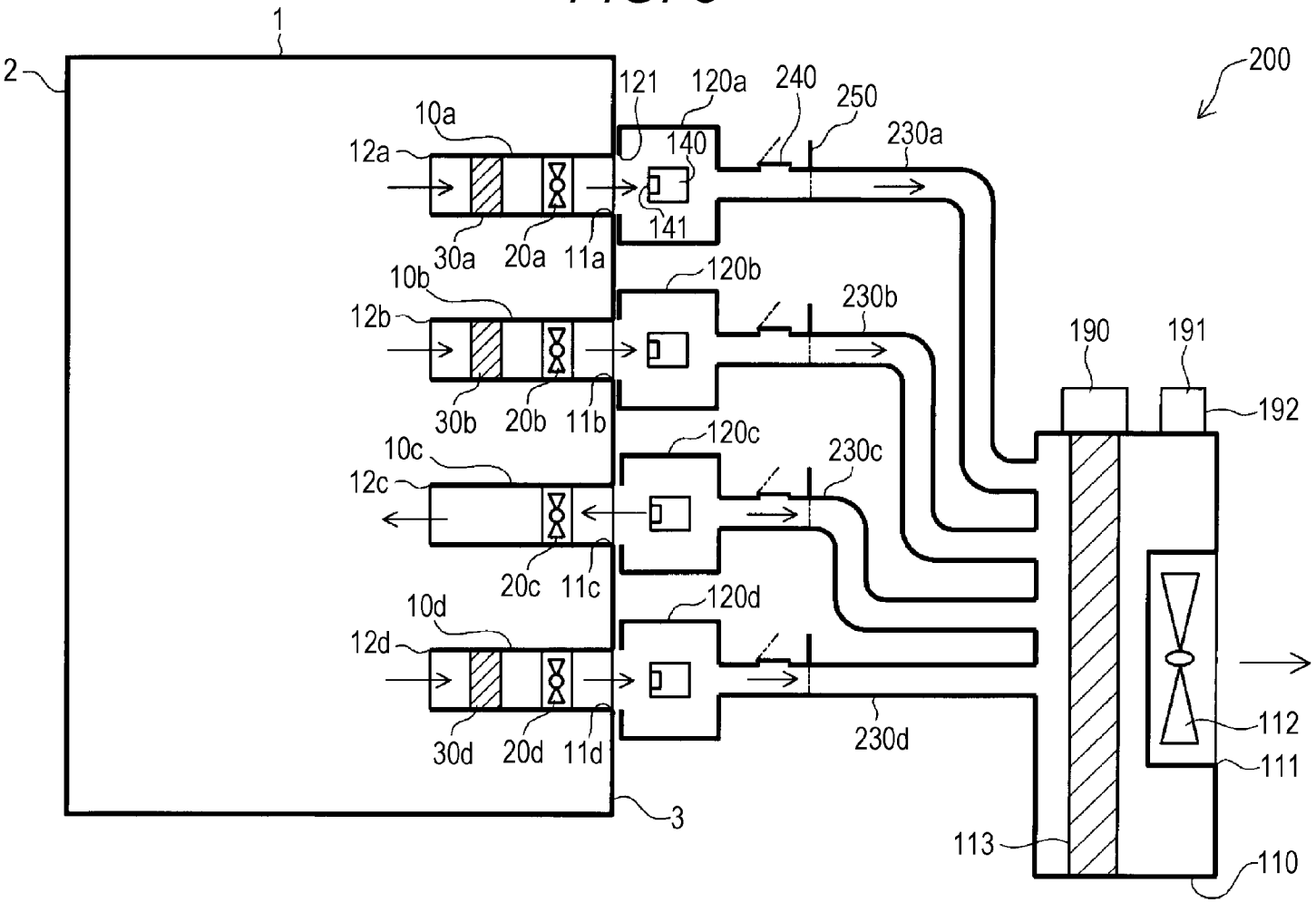
FIG. 5 is an explanatory schematic configuration diagram of an exhaust purification apparatus according to a second embodiment.

An exhaust purification apparatus 200 according to the present embodiment is depicted in FIG. 5. The exhaust purification apparatus 200 has hose ducts 230 that are different from those of the first embodiment. Other features such as the intake portions 120 and the main body portion 110 are the same as those of the first embodiment. Further, as in the first embodiment, the exhaust purification apparatus 200 of the present embodiment is attachable to the image forming apparatus 1 (FIG. 1). Moreover, the exhaust purification apparatus 200 is attachable to an image forming apparatus having ventilation ports that are different in arrangement from the ventilation ports 11 of the image forming apparatus 1.

As depicted in FIG. 5, the hose ducts 230 of the exhaust purification apparatus 200 according to the present embodiment are each provided with an opener 240. The hose ducts 230 of the present embodiment are each provided in the exhaust paths thereof with a shutter 250 on the downstream side of the opener 240.

Figure 6:
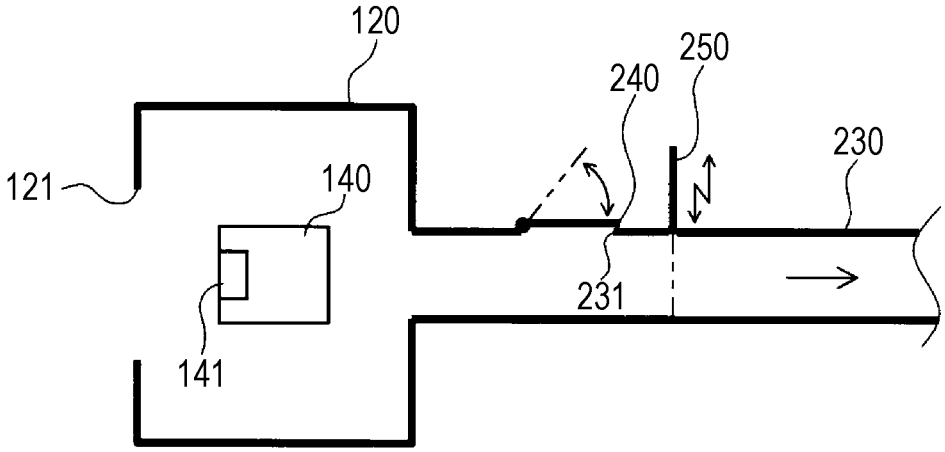
FIG. 6 is an explanatory diagram of an opener and a shutter of the exhaust purification apparatus according to the second embodiment.

FIG. 6 is an explanatory diagram of an opener 240 and a shutter 250. The opener 240 may take an open state indicated by the alternate long and short dashed line in FIG. 6 and a closed state indicated by the solid line in FIG. 6. In the open state of the opener 240, the inside and outside of the hose duct 230 are communicated with each other at the opening 231 provided in the hose duct 230, so as to allow air to pass through the opening 231. Meanwhile, in the closed state of the opener 240, flow of air between the inside and outside of the hose duct 230 is blocked at the opening 231, and air is unable to pass through the opening 231.

The shutter 250 also may take a closed state indicated by the alternate long and short dashed line in FIG. 6 and an open state indicated by the solid line in FIG. 6. In the closed state of the shutter 250, flow of air inside the hose duct 230 is blocked at the location of the shutter 250. Meanwhile, in the open state of the shutter 250, flow of air inside the hose duct 230 is not blocked at the location of the shutter 250.

With respect to intake portions 120 of the exhaust purification apparatus 200 that are connected to outlets of the image forming apparatus, the openers 240 of the hose ducts 230 of the intake portions 120 are in a closed state and the shutters 250 are in an open state. Since the air to be discharged from the outlets of the image forming apparatus that are connected with the intake portions 120 does not leak from the openings 231 to the outside because the openers 240 are in a closed state.

Further, since the air to be discharged from the outlets of the image forming apparatus that are connected with the intake portions 120 flows past the positions of the shutters 250 toward the main body portion 110 when the exhaust fan 112 is driven, since the shutters 250 are in an open state. Hence, upon driving of the exhaust fan 112 with the openers 240 of the hose ducts 230 in a closed state and the shutters 250 in an open state, purification is performed on the exhaust from the outlets of the image forming apparatus that are connected with the intake portions 120 of the hose ducts 230.

Meanwhile, the intake portion 120 connected to a non-outlet ventilation port of the image forming apparatus has the opener 240 of the hose duct 230 in an open state and the shutter 250 in a closed state. Since the opener 240 is in an open state, air is sucked at the non-outlet ventilation port of the image forming apparatus, which ventilation port is connected with the intake portion 120, for example, from the outside of the hose duct 230 through the opening 231.

Further, since the shutter 250 is in a closed state, the non-outlet ventilation port of the image forming apparatus, which ventilation port is connected with the intake portion 120, is not subject to the influence of airflow to occur inside the exhaust purification apparatus 200 by the action of the exhaust fan 112 in, for example, sucking ambient air through the opening 231. Hence, with respect to the intake portion 120 of the hose duct 230 having the opener 240 in an open state and the shutter 250 in a closed state, a disabled state is achieved in which flow of air is not obstructed at the ventilation port connected with the intake portion 120.

As in the first embodiment, the exhaust purification apparatus 200 according to the present embodiment is operable to execute the normal mode and the attachment determination mode. The exhaust purification apparatus 200 is also operable to execute the attachment initial determination mode (FIG. 2) and the per-job determination mode (FIG. 3) as the attachment determination mode. Procedures for these attachment determination modes are the same as those of the first embodiment.

More specifically, in the attachment initial determination mode (FIG. 2), in case where there is not any ventilation port that is connected with an intake portion 120 (S105: NO), the user is instructed to disable the connection of the intake portions 120 that are connected to the non-outlet ventilation ports (S106). In the per-job determination mode (FIG. 3) also, in case where there is not any ventilation port that is determined to have been connected with an intake portion 120 (S203: NO), the user is instructed to disable the connection of the intake portions 120 that are connected with the non-outlet ventilation ports (S204).

After that, in the exhaust purification apparatus 200 according to the present embodiment, the user opens the opener 240 and closes the shutter 250 of the hose duct 230 of the intake portion 120 that is determined to have been connected to a non-outlet ventilation port. This allows the connection of the intake portion 120 to be disabled as if the intake portion 120 were detached, even easier than detaching the intake portion 120.

Further, since disablement of the intake portions 120 is performed without detaching the intake portions 120 in the exhaust purification apparatus 200, for example, the intake portions 120 may be connected to ventilation ports of the image forming apparatus by using adhesive. Thus, the intake portions 120 are connected more firmly with the ventilation ports of the image forming apparatus as compared to the connection in the first embodiment and, for example, exhaust leakage from the connection portions is suppressed.

It is to be noted that in the attachment determination mode, the user is preferably instructed by way of the display 191 to close the opener 240 and open the shutter 250 of the hose duct 230 of an intake portion 120 that is determined to have been connected to an outlet. This is because by doing so, for example, exhaust leakage from the opener 240 is suppressible during the normal mode to be executed thereafter.

Further, the respective openers 240 and the shutters 250 of the hose ducts 230 may operate in conjunction with each other. This allows the intake portions 120 to be, for example, easily disabled. This also prevents a mistake such as opening/closing both an opener 240 and a shutter 250 at the same time.

Figure 7:
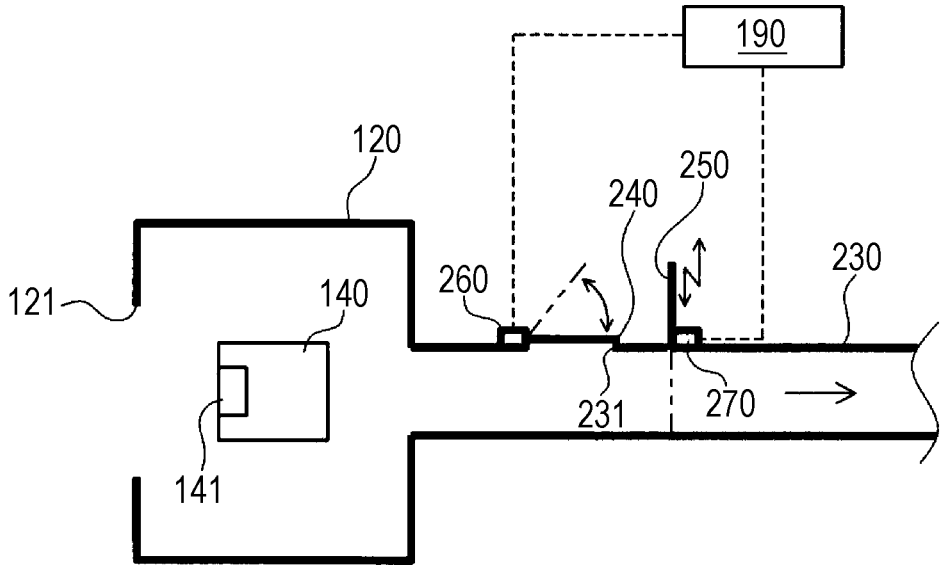
FIG. 7 is an explanatory diagram of a variation of the opener and the shutter.

Moreover, for example, as depicted in FIG. 7, the exhaust purification apparatus 200 preferably has opener drivers 260 configured to open/close the openers 240 and shutter drivers 270 configured to open/close the shutters 250. This saves time and labor of the user to open/close the openers 240 and the shutters 250 by herself. Further, the attachment determination mode is certainly executed automatically by the exhaust purification apparatus 200.

With the configuration of FIG. 7, in the attachment initial determination mode (FIG. 2), the controller 190 disables, in case where an intake portion 120 is connected to a non-outlet ventilation port (S105: NO), the intake portion 120 instead of issuing an instruction to disable the connection of the intake portion 120 (S106). Likewise in the per-job determination mode (FIG. 3), in case where an intake portion 120 is connected to a non-outlet ventilation port (S203: NO), the intake portion 120 is disabled in place of issuance of an instruction to disable the connection of the intake portion 120 (S204). In other words, the opener driver 260 causes the opener 240 to be opened, which opener 240 belongs to the hose duct 230 of the intake portion 120 that is connected to a non-outlet ventilation port. Further, the shutter driver 270 causes the shutter 250 to be closed.

In addition, the controller 190 may also determine at the exhaust purification apparatus 200 that a ventilation port is an outlet when an exhaust air volume at or above a predefined threshold for the exhaust air volume is detected at the ventilation port. This allows the exhaust purification apparatus 200 to be properly attached to an image forming apparatus having a ventilation port that is designed for free convection or weak air discharge. Further, determination may be made by the configuration of FIG. 4 and not by the air volume sensors 140 as to whether a ventilation port that is connected with an intake portion 120 is an outlet or not. In addition, the per-Mb determination mode may be executed per elapse of a certain length of time even after the execution of the normal mode has been started. In the normal mode, the pressure on the upstream side of the purification filter 113 of the exhaust purification apparatus 200 is preferably set at or below the atmospheric pressure. Moreover, the pressure on the upstream side of the purification filter 113 of the exhaust purification apparatus 200 is more preferably set in a range of −30 Pa to 0 Pa.

As described above in detail, the exhaust purification apparatus 200 according to the present embodiment has the openers 240 in the respective hose ducts 230 of the intake portions 120. Thus, the intake portions 120 are easily disabled without detaching the intake portions 120. Further, the intake portions 120 are disabled while still in connection with the ventilation ports of the image forming apparatus. Thus, an intake portion 120 may be disabled once, and then the disabled intake portion 120 may be enabled when air is discharged from the ventilation port that is connected with the intake portion 120, so as to purify exhaust from the image forming apparatus.

It is to be noted that the present embodiment is merely an illustration and is not intended to limit the present invention in any way. Accordingly, the embodiment of the present invention naturally allows for various improvements and modifications without departing from the scope of the invention. For example, the hose ducts may each be provided with the purification filter. And for example, the intake portions and the hose ducts may be provided in any number.

Further, for example, the hose ducts at least have openers, and the shutters may be omitted in case where airflow to be created by the exhaust fan does not interfere with the function of the ventilation ports of the image forming apparatus. Further, for example, the openers and the shutters may be disposed in the intake portions. Further, for example, in case where the openers and the shutters are configured to be automatically opened/closed, providing the drivers to each opener and shutter is optional. More specifically, the driver may be provided by one, and the driver may be coupled with the openers and the shutters by, for example, a timing belt, so as to drive the openers and the shutters.

Further, the present embodiment is applicable to, for example, a so-called four-cycle electrographic image forming apparatus in which developing devices for each color are disposed around one photosensitive body, in addition to the above-described image forming apparatus 1 in the form of a tandem electrographic color printer. Moreover, the present embodiment is applicable to, for example, monochrome copiers and printers, facsimiles, or multifunction machines integrally having these functions.

Third Embodiment

A third embodiment is described. An exhaust purification apparatus according to the present embodiment is a dedicated item that is compatible with a particular type of image forming apparatus, unlike a generic product according to the foregoing embodiments which is compatible with various types of image forming apparatus.

Figure 8:
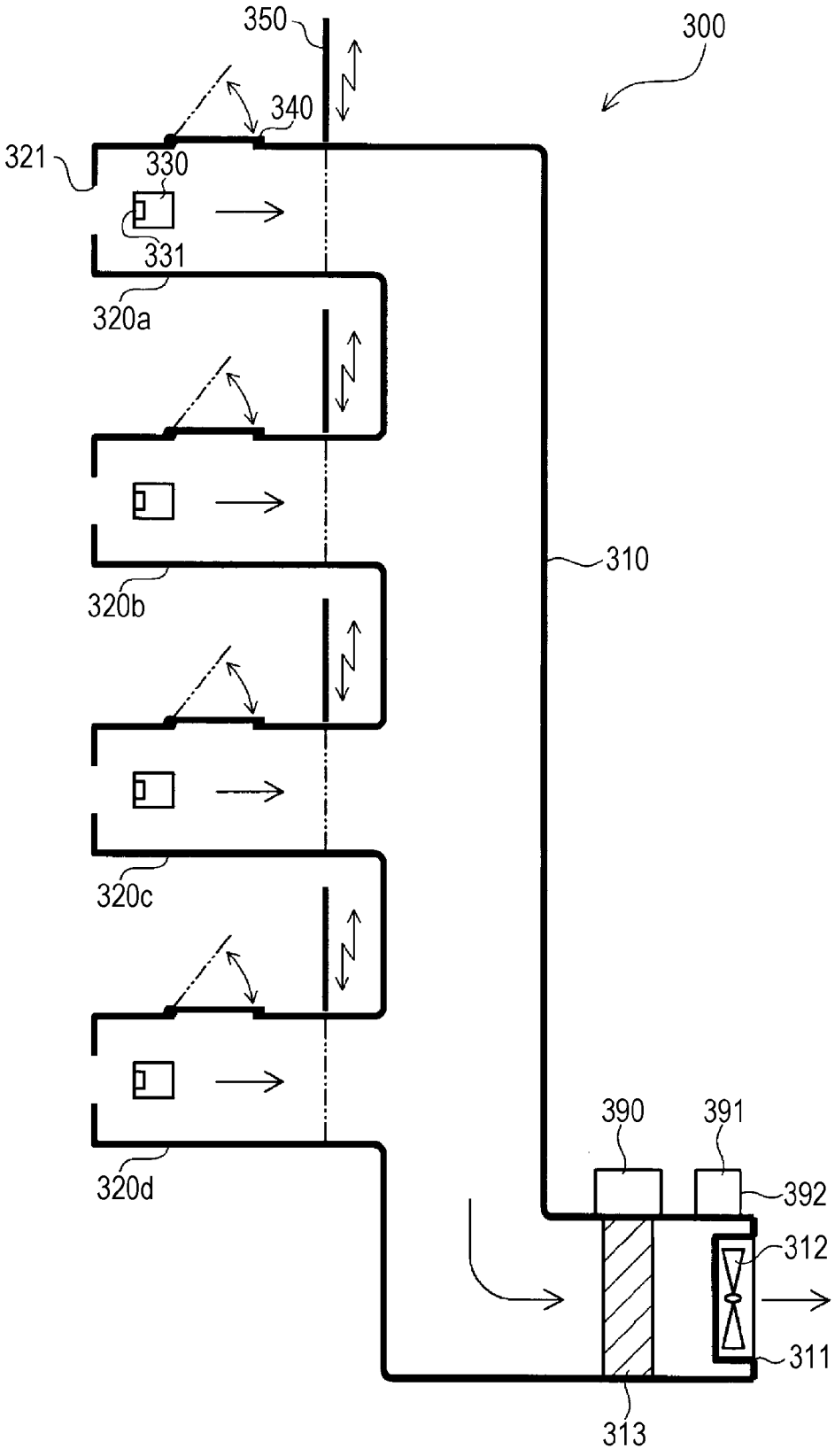
FIG. 8 is an explanatory schematic configuration diagram of an exhaust purification apparatus according to a third embodiment.

FIG. 8 depicts an exhaust purification apparatus 300 according to the present embodiment. The exhaust purification apparatus 300 has a merging duct 310 and intake portions 320*a*, 320*b*, 320*c*, and 320*d*. The intake portions 320 are each provided with an inlet 321 in the left-hand side in FIG. 8. The inlets 321 are each provided at a position that corresponds to an outlet of a particular type of image forming apparatus to be attached with the exhaust purification apparatus 300. The exhaust purification apparatus 300 does not have a hose duct that is freely bendable by the user and is operable flexibly. Thus, the exhaust purification apparatus 300 is a dedicated product for the particular type of image forming apparatus.

Air volume sensors 330 are disposed in the vicinity of the inlets 321 in the intake portions 320. According to the present embodiment also, the air volume sensors 330 are operable to detect exhaust from outlets of the image forming apparatus in case where the intake portions 320 are connected to the outlets.

The intake portions 320 are each provided with an opener 340 and a shutter 350. The shutters 350 are disposed on the downstream side of the openers 340 in the exhaust paths. The openers 340 and the shutters 350 are both configured to take an open state and a closed state as in the second embodiment.

As depicted in FIG. 8, the intake portions 320 are each connected to the merging duct 310. The merging duct 310 is provided therein with an exhaust fan 312 and a purification filter 313. The exhaust fan 312 and the purification filter 313 are both arranged on the downstream side, in the exhaust path, of any of the positions at which the intake portions 320 are connected to the merging duct 310.

The exhaust fan 312 is configured to discharge air inside the exhaust purification apparatus 300 to the outside through an outlet 311. The purification filter 313 is higher in performance than the internal filters of the image forming apparatus to be attached with the exhaust purification apparatus 300 and recovers byproducts that are not recoverable by the internal filters.

Moreover, the exhaust purification apparatus 300 also has a controller 390 that is configured to perform control over the portions, and a display 391 for appropriately displaying, for example, instructions to the user on a display panel 392. In the present embodiment also, the controller 390 executes the normal mode and the attachment determination mode. In the exhaust purification apparatus 300 also, the attachment initial determination mode (FIG. 2) and the per-job determination mode (FIG. 3) are executable as the attachment determination mode. Procedures for these attachment determination modes are the same as those of the foregoing embodiments.

It is here to be noted that the exhaust purification apparatus 300 according to the present embodiment is a dedicated product for a particular type of image forming apparatus. Thus, in case where the exhaust purification apparatus 300 is attached to such a special image forming apparatus, the attachment initial determination mode may be skipped. This is because the inlets 321 in the intake portions 320 are arranged at positions that correspond respectively to the outlets of the special image forming apparatus. However, despite an image forming apparatus that is not the special image forming apparatus, in case where the arrangement of ventilation ports correspond to the inlets 321 of the exhaust purification apparatus 300, the user may erroneously attach the exhaust purification apparatus 300 to such an image forming apparatus.

Thus, in case where the user erroneously attaches the exhaust purification apparatus 300 to an image forming apparatus that is not the special image forming apparatus, a ventilation port connected with an inlet 321 may not be an outlet. When the inlet 321 is connected to, for example, to an inlet, the user is instructed to disable the intake portion 320 to which the inlet 321 belongs, as in the second embodiment. Disablement of the intake portions 320 is also performed as in the second embodiment by opening the opener 340 and closing the shutter 350. This obviates, for example, malfunction of the image forming apparatus to which the exhaust purification apparatus 300 is attached.

In the per-job determination mode, in case where the exhaust purification apparatus 300 is erroneously attached to an image forming apparatus that is not the special image forming apparatus, the user is instructed to disable the intake portions 320 per job. As in the second embodiment, the present embodiment is especially useful when the special image forming apparatus has a ventilation port that is switchable between air intake and air discharge per job.

It is to be noted that in the attachment determination mode, the user is preferably instructed by way of the display 391 to close the opener 340 and open the shutter 350 of an intake portion 320 that is determined to have been connected to an outlet. This is because by doing so, for example, exhaust leakage from the opener 340 is suppressible during the normal mode to be executed thereafter.

Further, the respective openers 340 and the shutters 350 of the intake portions 320 may operate in conjunction with each other. This allows the intake portions 320 to be, for example, easily disabled. This also prevents a mistake such as opening/closing both an opener 340 and a shutter 350 at the same time.

Moreover, for example, as depicted in FIG. 7 in connection with the second embodiment, the exhaust purification apparatus 300 also preferably has drivers configured to open/close the openers 340 and the shutters 350. This saves time and labor of the user to open/close the openers 340 and the shutters 350 by herself. Further, the attachment determination mode is certainly executed automatically by the exhaust purification apparatus 300.

In addition, the controller 390 may also determine at the exhaust purification apparatus 300 that a ventilation port is an outlet when an exhaust air volume at or above a predefined threshold for the exhaust air volume is detected at the ventilation port. This suppresses malfunction of the image forming apparatus even in case where the exhaust purification apparatus 300 is erroneously attached to an image forming apparatus that is not the special image forming apparatus and an intake portion 320 is connected to a ventilation port that is designed for free convection or weak air discharge. Further, determination may be made by the configuration of FIG. 4 and not by the air volume sensors 330 as to whether a ventilation port that is connected with an intake portion 320 is an outlet or not. In addition, the per-job determination mode may be executed per elapse of a certain length of time even after the execution of the normal mode has been started. In the normal mode, the pressure on the upstream side of the purification filter 313 of the exhaust purification apparatus 300 is preferably set at or below the atmospheric pressure. Moreover, the pressure on the upstream side of the purification filter 313 of the exhaust purification apparatus 300 is more preferably set in a range of −30 Pa to 0 Pa.

As has been described above in detail, the exhaust purification apparatus 300 according to the present embodiment is a dedicated product for a particular type of image forming apparatus. However, even in case where the exhaust purification apparatus 300 is attached to an image forming apparatus that is not the special image forming apparatus, byproducts generated with image formation are appropriately recovered with an adverse effect on the internal devices of the image forming apparatus and degradation in quality of images to be formed being suppressed. Also for the image forming apparatus having an inlet that is switchable between air intake and air discharge per job, byproducts generated with image formation are appropriately recovered with an adverse effect on the internal devices and degradation in quality of images to be formed being suppressed.

It is to be noted that the present embodiment is merely an illustration and is not intended to limit the present invention in any way. Accordingly, the embodiment of the present invention naturally allows for various improvements and modifications without departing from the scope of the invention. For example, the intake portions may each be provided with the purification filter. And for example, the intake portions may be provided in any number.

Further, for example, the shutters may be omitted in case where airflow to be created by the exhaust fan does not interfere with the function of the ventilation ports of the image forming apparatus. Further, for example, in case where the openers and the shutters are configured to be automatically opened/closed, providing the drivers to each opener and shutter is optional. More specifically, the driver may be provided by one, and the driver may be coupled with the openers and the shutters by, for example, a timing belt, so as to drive the openers and the shutters.

Further, the present embodiment is applicable to, for example, a so-called four-cycle electrographic image forming apparatus in which developing devices for each color are disposed around one photosensitive body, in addition to the above-described image forming apparatus in the form of a tandem electrographic color printer. Moreover, the present embodiment is applicable to, for example, monochrome copiers and printers, facsimiles, or multifunction machines integrally having these functions.

Fourth Embodiment

A fourth embodiment is described. An exhaust purification apparatus according to the present embodiment is a dedicated item that is compatible with a particular type of image forming apparatus, and has an exhaust fan in each intake portion.

Figure 9:
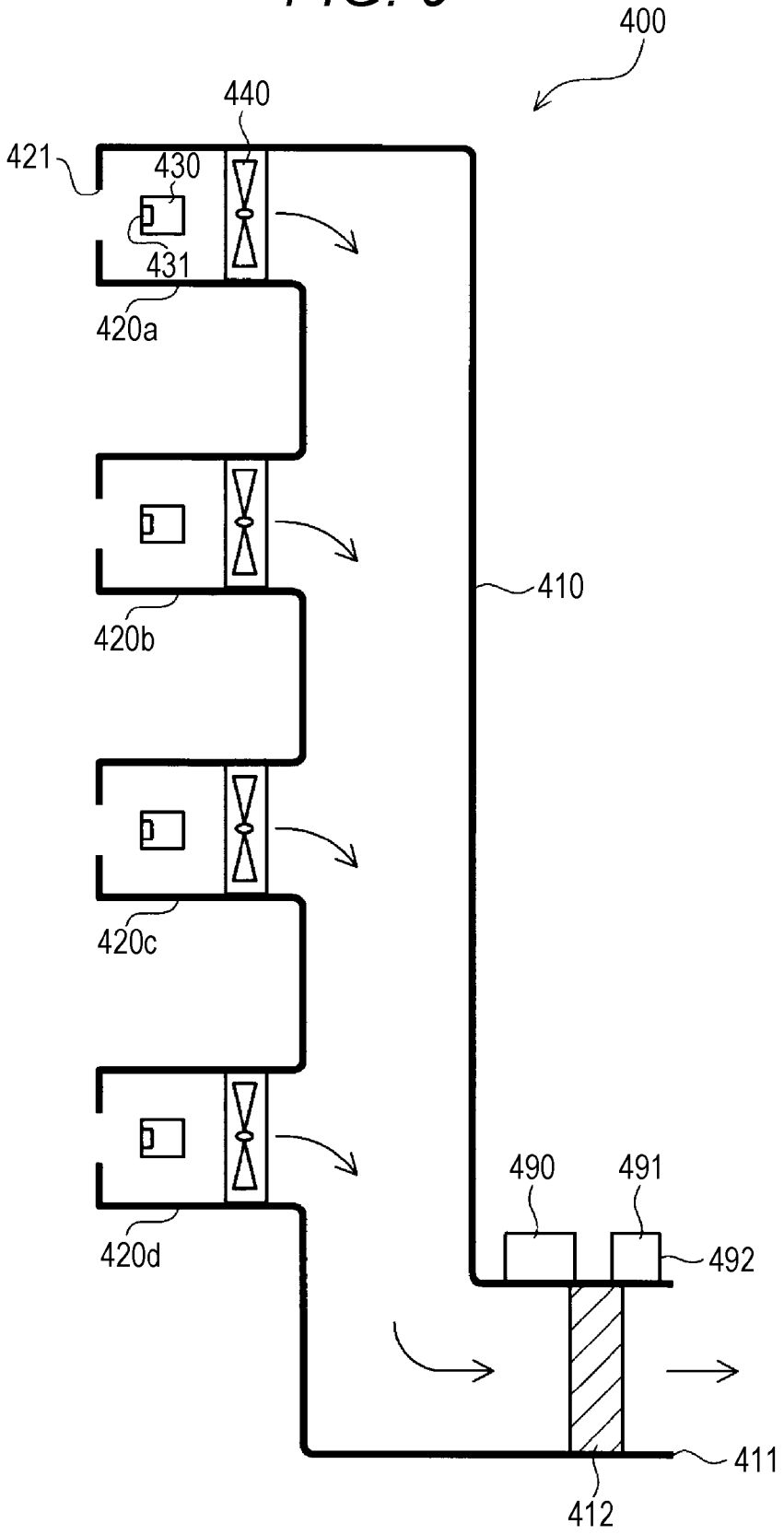
FIG. 9 is an explanatory schematic configuration diagram of an exhaust purification apparatus according to a fourth embodiment.

FIG. 9 depicts an exhaust purification apparatus 400 according to the present embodiment. The exhaust purification apparatus 400 has a merging duct 410 and intake portions 420*a*, 420*b*, 420*c*, and 420*d*. The intake portions 420 are each provided with an inlet 421 in the left-hand side in FIG. 9. The inlets 421 are provided at positions that correspond respectively to the outlets of the particular type of image forming apparatus to be attached with the exhaust purification apparatus 400. Unlike the first and second embodiments, the exhaust purification apparatus 400 does not have a hose duct that is freely bendable by the user and is operable flexibly. Thus, the exhaust purification apparatus 400 is a dedicated product for the particular type of image forming apparatus.

Air volume sensors 430 are disposed in the vicinity of the respective inlets 421 of the intake portions 420. In the present embodiment also, the air volume sensors 430 are operable to detect exhaust from the image forming apparatus in case where the intake portions 420 are connected to the outlets of the image forming apparatus.

As depicted in FIG. 9, each of the intake portions 420 is connected to the merging duct 410. A purification filter 412 is disposed in the merging duct 410. Also in the present embodiment, the purification filter 412 is configured to recover byproducts that are not recoverable by the internal filters of the image forming apparatus to be attached with the exhaust purification apparatus 400.

In the exhaust purification apparatus 400 according to the present embodiment, exhaust fans 440 are each disposed in the intake portions 420. The exhaust fans 440 are each configured to direct air inside the intake portion 420 from the inlet 421 to the merging duct 410, such that air inside the exhaust purification apparatus 400 is discharged from an outlet 411 to the outside.

Moreover, the exhaust purification apparatus 400 also has a controller 490 that is configured to perform control over the portions, and a display 491 for appropriately displaying, for example, instructions to the user on a display panel 492. And also in the present embodiment, the controller 490 executes the normal mode and the attachment determination mode. Further, in the exhaust purification apparatus 400 also, the attachment initial determination mode and the per-job determination mode are executed as the attachment determination mode.

In the attachment initial determination mode (FIG. 2), in case where an intake portion 420 is connected to a non-outlet ventilation port (S105: NO), the controller 490 of the exhaust purification apparatus 400 according to the present embodiment disables the intake portion 420 in place of issuance of an instruction to disable the connection of the intake portion 420 (S106). Likewise in the per-job determination mode (FIG. 3), in case where an intake portion 420 is connected to a non-outlet ventilation port (S203: NO), the intake portion 420 is disabled in place of issuance of an instruction to disable the connection of the intake portion 420 (S204). Disablement of the intake portion 420 in the exhaust purification apparatus 400 is performed by way of the exhaust fan 440 of the intake portion 420.

More specifically, with respect to the intake portion 420 that is disabled in the attachment determination mode, the exhaust fan 440 thereof is not driven and kept stopped even when the normal mode is executed thereafter. In this manner, the air inside the intake portion 420 in which the exhaust fan 440 is being stopped does not flow into the merging duct 410, thereby achieving a disabled state without disturbance of the function of the ventilation port of the image forming apparatus, which ventilation port is connected with the intake portion 420.

It is to be noted that with respect to the intake portions 420 that are determined as being connected to outlets, disablement of the exhaust fans 440 by stopping is canceled in the attachment determination mode, and then the exhaust fans 440 are driven in the subsequent normal mode.

In addition, the controller 490 may also determine at the exhaust purification apparatus 400 that a ventilation port is an outlet when an exhaust air volume at or above a predefined threshold for the exhaust air volume is detected at the ventilation port. This suppresses, for example, malfunction of the image forming apparatus even in case where the exhaust purification apparatus 400 is erroneously attached to an image forming apparatus that is not the special image forming apparatus and an intake portion 420 is connected to a ventilation port that is designed for free convection or weak air discharge. Further, determination may be made by the configuration of FIG. 4 and not by the air volume sensors 430 as to whether the ventilation port that is connected with an intake portion 420 is an outlet or not. In addition, the per-job determination mode may be executed per elapse of a certain length of time even after the execution of the normal mode has been started. In the normal mode, the pressure on the upstream side of the purification filter 412 of the exhaust purification apparatus 400 is preferably set at or below the atmospheric pressure. Moreover, the pressure on the upstream side of the purification filter 412 of the exhaust purification apparatus 400 is more preferably set in a range of −30 Pa to 0 Pa.

It is to be noted that the normal mode is executed in such a way that the pressure on the upstream side of the purification filter 412 of the exhaust purification apparatus 400 becomes a negative pressure, air inside the disabled intake portion 420 will also flow to the merging duct 410. The flow of air is of an insignificant volume, and thus does not disturb the function of the ventilation port of the image forming apparatus, which ventilation port is connected with the disabled intake portion 420. In case where the configuration lets a significant amount of air inside the disabled intake portion 420 flow into the merging duct 410, openers and shutters may be provided to the intake portions 420 as in the second and third embodiments.

As has been described above in detail, the exhaust purification apparatus 400 according to the present embodiment has the exhaust fans 440 provided in the intake portions 420. With respect to an intake portion 420 that is disabled in the attachment determination mode, the exhaust fan 440 thereof is stopped in the subsequent normal mode. This allows byproducts generated with image formation to be appropriately recovered while suppressing an adverse effect on the internal devices of the image forming apparatus attached with the exhaust purification apparatus 400 as well as degradation in quality of images to be formed.

It is to be noted that the present embodiment is merely an illustration and is not intended to limit the present invention in any way. Accordingly, the embodiment of the present invention naturally allows for various improvements and modifications without departing from the scope of the invention. For example, the intake portions may each be provided with the purification filter. And for example, the intake portions may be provided in any number.

Further, the present embodiment is applicable to, for example, a so-called four-cycle electrographic image forming apparatus in which developing devices for each color are disposed around one photosensitive body, in addition to the above-described image forming apparatus in the form of a tandem electrographic color printer. Moreover, the present embodiment is applicable to, for example, monochrome copiers and printers, facsimiles, or multifunction machines integrally having these functions.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An exhaust purification apparatus comprising:

a purification duct configured to purify air to be discharged from a ventilation port in an image forming apparatus, the purification duct including:

at least one inlet communicating with an interior of the purification duct for connection with the ventilation port in the image forming apparatus;

an outlet configured to discharge air inside the purification duct to the outside;

a fan configured to direct air from the inlet toward the outlet;

a filter configured to recover particles in the air, the fan and the filter each being disposed in the purification duct at a position between the inlet and the outlet;

an airflow detector configured to detect an airflow at the inlet; and a controller configured to execute a normal mode and an attachment determination mode, the normal mode being adapted such that the fan is driven with the inlet being in connection with the ventilation port in the image forming apparatus, to purify an exhaust from the ventilation port in the image forming apparatus, the attachment determination mode being adapted such that a determination is made as to whether the ventilation port in the image forming apparatus being in connection with the inlet is a ventilation port for discharging air, based on the airflow detected by the airflow detector, wherein the controller is configured to perform a disabling control to disable the connection of the inlet with the ventilation port in the image forming apparatus, the inlet having been determined in the attachment determination mode as being in connection with the ventilation port other than the ventilation port for discharging air in the image forming apparatus, and the controller is configured to execute the normal mode in presence of the inlet having a non-disabled connection.

2. The exhaust purification apparatus according to claim 1, wherein, during execution of the attachment determination mode, the controller is configured to determine that the inlet is in connection with the ventilation port for discharging air in the image forming apparatus when the airflow detector detects at the inlet an airflow flowing from an exterior toward the interior of the purification duct, and the controller is configured to determine that the inlet is in connection with the ventilation port other than the ventilation port for discharging air in the image forming apparatus in absence of the determination that the inlet is in connection with the ventilation port for discharging air in the image forming apparatus.

3. The exhaust purification apparatus according to claim 2, wherein, during execution of the attachment determination mode, the controller is configured to determine that the inlet is in connection with the ventilation port for discharging air in the image forming apparatus when the airflow detector detects at the inlet the airflow flowing from the exterior toward the interior of the purification duct, the airflow having an air volume that is at or above a predefined threshold air volume.

4. The exhaust purification apparatus according to claim 1, wherein the controller is configured to execute the attachment determination mode with the fan being stopped.

5. The exhaust purification apparatus according to claim 1, further comprising an opener positioned on an upstream side of the fan in a direction of flow of air inside the purification duct, the opener having a closed state and an open state, the closed state being such that the interior and the exterior of the purification duct are in non-communication, the open state being such that the interior and the exterior of the purification duct are in communication, wherein the opener is configured to disable the connection of the inlet with the image forming apparatus when in the open state.

6. The exhaust purification apparatus according to claim 1, further comprising:

a display configured to display information to a user; and an inputter configured to accept an input from the user to initiate the execution of the attachment determination mode, wherein the controller is configured to cause an instruction to be displayed on the display when the inlet is connected to the ventilation port in the image forming apparatus and power is first turned on, the instruction prompting the input onto the inputter.

7. The exhaust purification apparatus according to claim wherein the airflow detector is configured to detect the airflow at the inlet during non-operation of the apparatus, and the controller is configured to execute the attachment determination mode when the airflow detector detects at the inlet the airflow flowing from the exterior toward the interior of the purification duct during non-operation of the apparatus, the controller is configured to execute the normal mode following the disabling control, in the presence of the inlet that is determined in the attachment determination mode as being in connection with the ventilation port other than the ventilation port for discharging air in the image forming apparatus, and the controller is configured to execute the normal mode without performing the disabling control, in the absence of the inlet that is determined in the attachment determination mode as being in connection with the ventilation port other than the ventilation port for discharging air in the image forming apparatus.

8. The exhaust purification apparatus according to claim 6, wherein the controller is configured to cause, in the disabling control, the display to display an instruction for disabling the connection of the inlet with the image forming apparatus.

9. The exhaust purification apparatus according to claim 5, further comprising an opener driver configured to perform an opening and closing operation of the opener, wherein the controller is configured to cause, in the disabling control, the opener driver to open the opener.

10. The exhaust purification apparatus according to claim 9, wherein the controller is configured to cause the opener driver to close the opener with respect to the inlet that is determined in the attachment determination mode as being in connection with the ventilation port for discharging air in the image forming apparatus.

11. The exhaust purification apparatus according to claim 1, further comprising:

a plurality of inlets identical to the inlet; and a plurality of fans provided for the plurality of the inlets, the fans being identical to the fan, wherein the controller is configured to perform the disabling control in such a manner as to execute the normal mode with a fan of the fans being stopped, the fan corresponding to an inlet of the inlets that is determined in the attachment determination mode as being in connection with the ventilation port other than the ventilation port for discharging air in the image forming apparatus.

* * * * *